US006623876B1

(12) United States Patent
Caron

(10) Patent No.: US 6,623,876 B1
(45) Date of Patent: Sep. 23, 2003

(54) SINTERED MECHANICAL PART WITH ABRASIONPROOF SURFACE AND METHOD FOR PRODUCING SAME

(75) Inventor: Paul Caron, Ste-Foy (CA)

(73) Assignee: Invegyre Inc., Quebec (CA)

( * ) Notice: Subject to any disclaimer, the term of this patent is extended or adjusted under 35 U.S.C. 154(b) by 0 days.

(21) Appl. No.: 09/424,586

(22) PCT Filed: May 27, 1998

(86) PCT No.: PCT/CA98/00516

§ 371 (c)(1),
(2), (4) Date: Nov. 24, 1999

(87) PCT Pub. No.: WO98/54379

PCT Pub. Date: Dec. 3, 1998

(30) Foreign Application Priority Data

May 28, 1997 (CA) ..... 2207579

(51) Int. Cl.[7] ..... B32B 9/00

(52) U.S. Cl. ..... 428/698; 428/699; 428/704; 428/908.8; 428/220; 428/325; 428/472; 144/208.1; 144/208.92; 51/309; 427/190; 427/554; 427/556; 427/597

(58) Field of Search ..... 428/908.8, 698, 428/699, 704, 220, 469, 472, 323, 325; 144/208.1, 208.92; 427/597, 596, 556, 554, 190; 51/307, 309

(56) References Cited

U.S. PATENT DOCUMENTS

| | | | | |
|---|---|---|---|---|
| 3,806,692 A | | 4/1974 | Few | 219/121 EM |
| 3,839,209 A | | 10/1974 | Hermann et al. | 252/12 |
| 4,218,494 A | | 8/1980 | Belmondo et al. | 427/35 |
| 4,353,155 A | | 10/1982 | Hillebrand et al. | 29/149.5 |
| 4,723,589 A | | 2/1988 | Iyer et al. | 164/46 |
| 4,723,996 A | | 2/1988 | Brunet et al. | 75/10.14 |
| 4,776,863 A | * | 10/1988 | van den Berg et al. | |
| 4,796,575 A | | 1/1989 | Matsubara et al. | 123/90.44 |
| 4,872,495 A | * | 10/1989 | Magnusson | |
| 5,032,469 A | | 7/1991 | Merz et al. | 428/662 |
| 5,043,548 A | * | 8/1991 | Whitney et al. | |

(List continued on next page.)

FOREIGN PATENT DOCUMENTS

| | | |
|---|---|---|
| CA | 1240476 | 8/1988 |
| CA | 2014504 | 10/1990 |
| CA | 2042200 | 1/1992 |

(List continued on next page.)

*Primary Examiner*—Deborah Jones
*Assistant Examiner*—Wendy Boss
(74) *Attorney, Agent, or Firm*—McDermott, Will & Emery

(57) ABSTRACT

The invention concerns a mechanical part with abrasion-proof surface characterized in that it comprises a sintered metallic body obtained from metallic powders and a laser-deposited cermet coating. The coating has a certain thickness whereof a portion is metallurgically bound with the metallic body. The laser deposit enables the sintered part to be surface-melted under the effect of the laser beam. The surface of the sintered part to be coated is therefore fused over a thickness ranging between 10 $\mu$m and 1 mm, which enables the surface pores to be closed, as is characteristic of sintered parts, thereby increasing its resistance to shocks. Moreover, the small surface coated at a given moment by the laser enables the self-hardening of the exposed part, following the beam displacement, by the heat-sink effect of the surrounding metallic volume. The resulting coating also has very low porosity owing to the complete fusion of the powders by laser.

11 Claims, 4 Drawing Sheets

U.S. PATENT DOCUMENTS

| | | | | | |
|---|---|---|---|---|---|
| 5,105,872 | A | | 4/1992 | Whiddon | 164/80 |
| 5,144,392 | A | | 9/1992 | Brotherton | 357/23.7 |
| 5,201,917 | A | | 4/1993 | Brunet et al. | 51/309 |
| 5,261,477 | A | | 11/1993 | Brunet et al. | 164/97 |
| 5,358,753 | A | | 10/1994 | Rao et al. | 427/451 |
| 5,362,523 | A | | 11/1994 | Gorynin et al. | 427/446 |
| 5,372,861 | A | | 12/1994 | Kerrand et al. | 427/596 |
| 5,426,278 | A | | 6/1995 | Hirano et al. | 219/121.63 |
| 5,441,693 | A | | 8/1995 | Ederyd et al. | |
| 5,449,536 | A | | 9/1995 | Funkhouser et al. | 427/597 |
| 5,453,329 | A | * | 9/1995 | Everett et al. | |
| 5,580,472 | A | | 12/1996 | Maybon | 219/121.66 |
| 5,612,099 | A | | 3/1997 | Thaler | 427/565 |
| 5,619,000 | A | * | 4/1997 | Ederyd et al. | |
| 5,629,091 | A | | 5/1997 | Rao et al. | 428/403 |
| 5,663,512 | A | * | 9/1997 | Schader et al. | |
| 5,789,077 | A | * | 8/1998 | Nakahama et al. | |

FOREIGN PATENT DOCUMENTS

| | | |
|---|---|---|
| CA | 2052899 | 4/1992 |
| CA | 2068185 | 12/1992 |
| CA | 2126517 | 1/1995 |
| CA | 2052893 | 10/1996 |
| DE | 2926879 | 1/1980 |
| DE | 3626031 | 2/1988 |
| DE | 4420496 | 12/1995 |
| EP | 0349501 | 1/1990 |
| EP | 0571210 | 11/1993 |
| EP | 0743428 | 11/1996 |
| FR | 2595716 | 3/1986 |
| FR | 2676673 | 11/1992 |
| GB | 2275437 | 8/1994 |
| JP | 5 2122446 | 5/1979 |
| JP | 6 3236037 | 3/1990 |
| JP | 6 3320696 | 6/1990 |
| JP | 0 1028267 | 8/1990 |
| WO | WO 8001489 | 7/1980 |
| WO | WO 8304382 | 12/1983 |
| WO | WO 9636465 | 11/1996 |
| WO | WO 9636979 | 11/1996 |

* cited by examiner

SINTERED MECHANICAL PART WITH ABRASIONPROOF SURFACE AND METHOD FOR PRODUCING SAME

FIELD OF THE INVENTION

The present invention concerns the abrasionproof surface treatment by laser of a mechanical part. More particularly, the present invention concerns the surface treatment of a sintered mechanical part obtained by powder metallurgy by laser deposit of a cermet coating, the cermet being a composite material formed by ceramic products coated in a metallic binder. The present invention also concerns a manufacturing method of such a mechanical part.

DESCRIPTION OF THE PRIOR ART

The coatings composed of spherical tungsten carbides in a nickel-chrome matrix and deposited by laser on cast irons or on traditional steel and thus, non sintered, already exist in the prior art. An example of this type of coating is described as an example in the Canadian patent application No. 2,126,517. The laser deposit is a coating technique that enables to deposit thick layers of very hard material on the surface of a metallic part. A continuous $CO_2$ laser delivers an infrared beam whose energy is used to superficially melt the base metal to be coated as well as the filler metal brought in the form of fine powder. A coaxial nozzle traversed in its centre by a laser beam enables the arrival and the injection of powders forming the coating, the latter resembling to a welding cord. To this day, this type of laser deposit has only been used to coat non sintered traditional metallic parts, used more particularly in very abrasive conditions.

It is well known in the prior art that the mechanical parts manufactured by powder metallurgy do not possess the physical characteristics to work in tension, in abrasion or in friction and this is due to the presence of a high number of pores in the surface of these sintered parts, thus decreasing the initiation period of the cracks in comparison to a forged or machined part. Thus, the porosity in the surface of the parts manufactured by powder metallurgy prevents the production of mechanical parts able to resist to shock and/or abrasive wear because of the brevity of the initiation period of the cracks.

BRIEF SUMMARY OF THE INVENTION

An object of the present invention is to propose a sintered mechanical part obtained by powder metallurgy and offering a very high resistance to shock, to abrasion and to friction, as well as a very good mechanical resistance of the body of the part.

More particularly, the object of the present invention is to propose a mechanical part with abrasionproof surface characterized in that it comprises:

- a sintered metallic body obtained by powder metallurgy; and
- a cermet coating covering the metallic body and having an external surface constituting the abrasionproof surface, the mechanical part being characterized in that:
  - said coating is obtained by laser deposit by coaxially injecting in a laser beam a flux of a mixture of metallic powders and ceramic powders containing spheroidal-shaped carbides, said mixture being intended to form said coating, which is characterized in that it is exempt of porosity, is metallurgically bound to the metallic body, has a thickness ranging from 10 microns to 1 mm and comprises spheroidal-shaped carbides in a metallic matrix.

A man of the art will understand that "metallurgically bound to the metallic body", means that the coating is fused to the surface of the sintered part, the microstructure at the base of the coating being intimately linked to the microstructure of the body of the part.

The mechanical part may comprise any part traditionally used in very abrasive conditions or in high tension, for example, the barking tools mounted on the barking arms.

The object of the present invention is also to propose a method for manufacturing the mechanical part described above. More particularly, the method is characterized in that it comprises the following steps:

a) providing a sintered mechanical part obtained by powder metallurgy; and b) depositing by laser process a cermet coating on an external surface of said mechanical part.

The laser process of deposit comprises, preferably, the following steps:

- guiding a laser beam on the external surface of the part, the laser beam releasing a certain temperature and fusing a certain thickness of said external surface;
- injecting in the laser beam a constant flux of a mixture of ceramic powders and of metallic powders intended to form the cermet coating, the ceramic powders having a higher fusion temperature than the temperature of the laser beam and the metallic powders having a lower fusion temperature than the temperature of the laser beam, so that the laser fuses the metallic powders of the powder mixture that is deposited on the external surface of the part; and
- displacing the laser beam relative to the mechanical part to thus sweep the external surface and form the cermet coating.

The powder mixture can be injected in the laser beam by means of a coaxial nozzle traversed in its centre by the laser beam, the nozzle allowing the arrival of the powder mixture and its injection in the laser beam.

The laser beam is, preferably, fixed and the mechanical part is installed on a mobile table movable relative to said laser beam.

The coating according to the present invention being deposited by laser enables the surface of the sintered part to be coated to melt under the effect of the laser beam. The surface of the sintered part to be covered is thus fused on a thickness ranging from 10 $\mu$m to 1 mm, which allows the closing of the pores on the surface, typical of sintered parts and, consequently, the increase of its resistance to shock. Moreover, the small surface covered at a given instant by the laser allows the self-hardening of the exposed zone, following the displacement of the beam, by heat-sink effect of the surrounding metallic volume. The coating obtained according to the present invention offers also a very low porosity because of the complete fusion of the filler metallic powders during their travel through the laser beam.

Other objects, characteristics and advantages of the present invention will be better understood by the following description of a preferred embodiment, made with reference to the accompanying drawings.

DESCRIPTION OF A PREFERRED EMBODIMENT ACCORDING TO THE INVENTION

Figure 1:
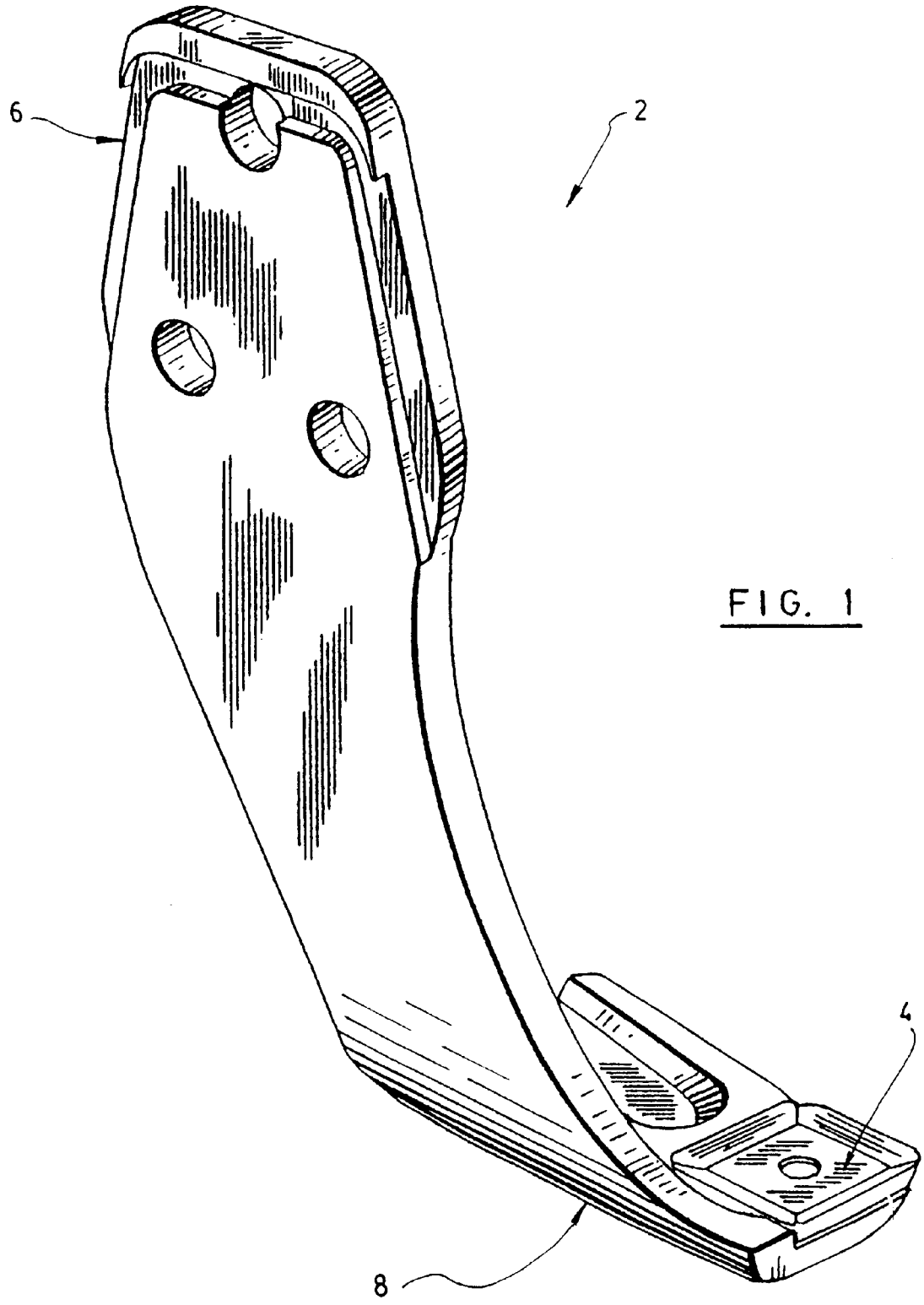
FIG. 1 is a perspective view of a barking arm on which is mounted a sintered barking tool having an abrasionproof coating according to a preferred embodiment of the present invention.

FIG. 1 shows a barking arm (2) for a rotary ring barker, arm on which is mounted a barking tool (4) manufactured according to the present invention. This arm (2) comprises a first extremity (6) adapted to be fixed on the rotating ring of the barker. The arm (2) comprises a second extremity (8) constituting the working surface of the arm (2) that serves to remove the bark of a tree as the latter is displaced longitudinally towards the inside of the ring. The tool (4) is operatively fixed to this second extremity. This second extremity (8) is the part of the arm that is used to bark the trees and must be able to resist to very abrasive conditions. A barking tool according to the present invention can thus advantageously be used, this one offering a very hard cermet coating being able to resist such working conditions. One must well understand that, although the preferred embodiment illustrated here represents a barking tool, this is only one example of a mechanical part according to the present invention among many others. In fact, any mechanical part traditionally used in very abrasive conditions or in high tension can be manufactured according to the present invention. The following mechanical parts are other examples of parts that can be manufactured according to the present invention:

- in the mining industry: grinders, wrecking balls, crushers, conveyors, etc.;
- in the ceramic and other related industries: scrapers, knives, moulds, conveyor screws, lockgates, etc.;
- in the pulp and paper industry: refining plates, pulping plates, pallets, etc.;
- in the metallurgy industry: cylinders, rings, pebbles, etc.;
- in the moulding industry: thread tips of screws for extrusion and injection; and
- in the food industry: rollers, filers, deflectors, screws.

Figure 2:
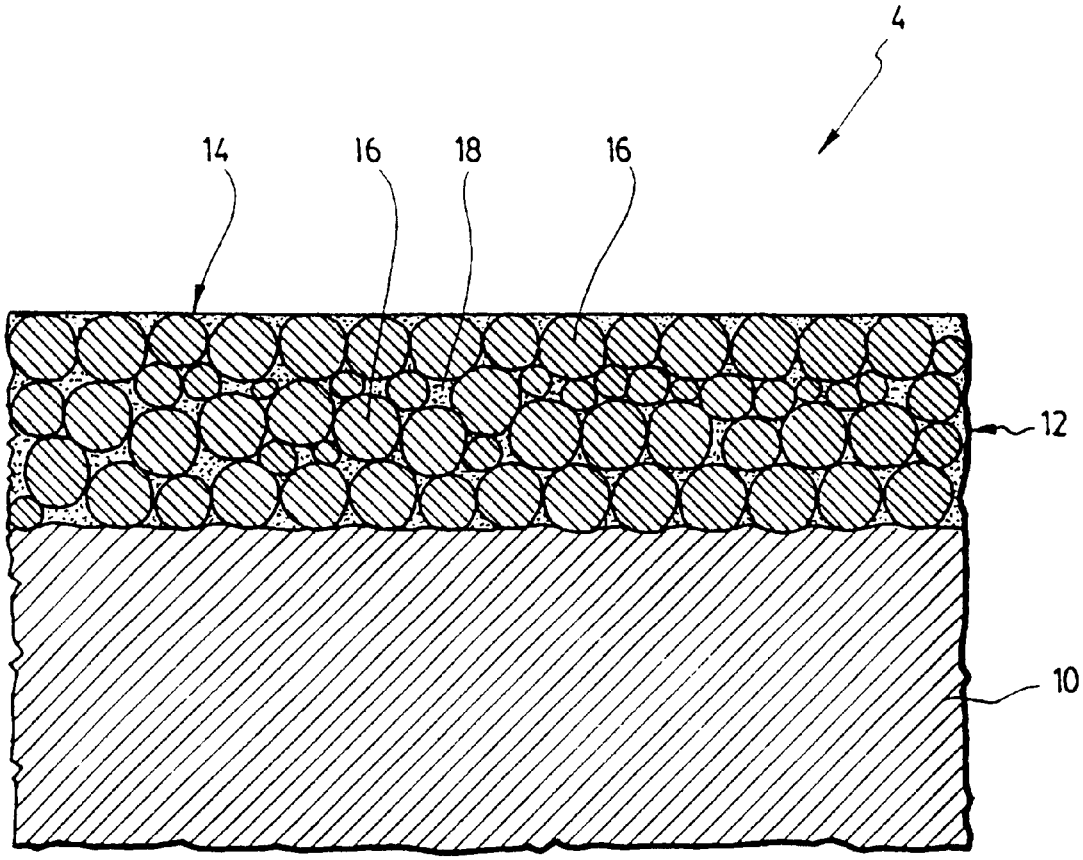
FIG. 2 represents schematically a cross section of a portion of the working surface of the barking tool of FIG. 1.
Figure 5:
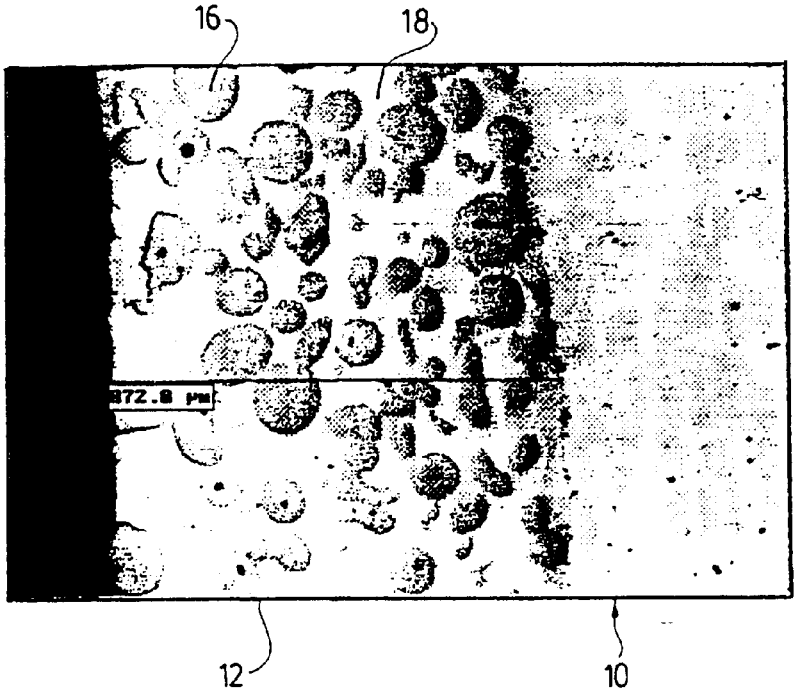
FIG. 5 is a picture taken by scanning electron microscopy (SEM) showing the microstructure of the interface between a coating obtained by laser deposit and the surface of a part obtained by powder metallurgy, according to the present invention.

As illustrated in FIG. 2, the barking tool (4) with abrasionproof surface, or any other mechanical part according to the present invention, comprises a sintered metallic body (10) obtained by powder metallurgy and a cermet coating (12) covering the metallic body (10). The external surface (14) of the coating constitutes the abrasionproof surface of the part. The coating (12) has a certain thickness of which a portion is metallurgically bound to the metallic body (10), as can be seen in FIG. 5. This portion ranges, preferably, from 10 $\mu$m to 1 mm.

The cermet coating (12) is preferably tungsten carbide (16), titanium carbide or boron carbide based, of spheroidal shape in a metallic matrix (18).

The metallic matrix (18) is preferably formed with at least one of the metals chosen from the group consisting of nickel, chromium and cobalt, more particularly it comprises nickel, chromium and cobalt. Advantageously, the Ni-9%Cr—Co is used.

The coating (12) comprises preferably 65% in weight of tungsten carbides (16) and is substantially exempt from porosity.

The coating (12) for a sintered part according to the present invention is obtained by laser deposit.

Figure 3:
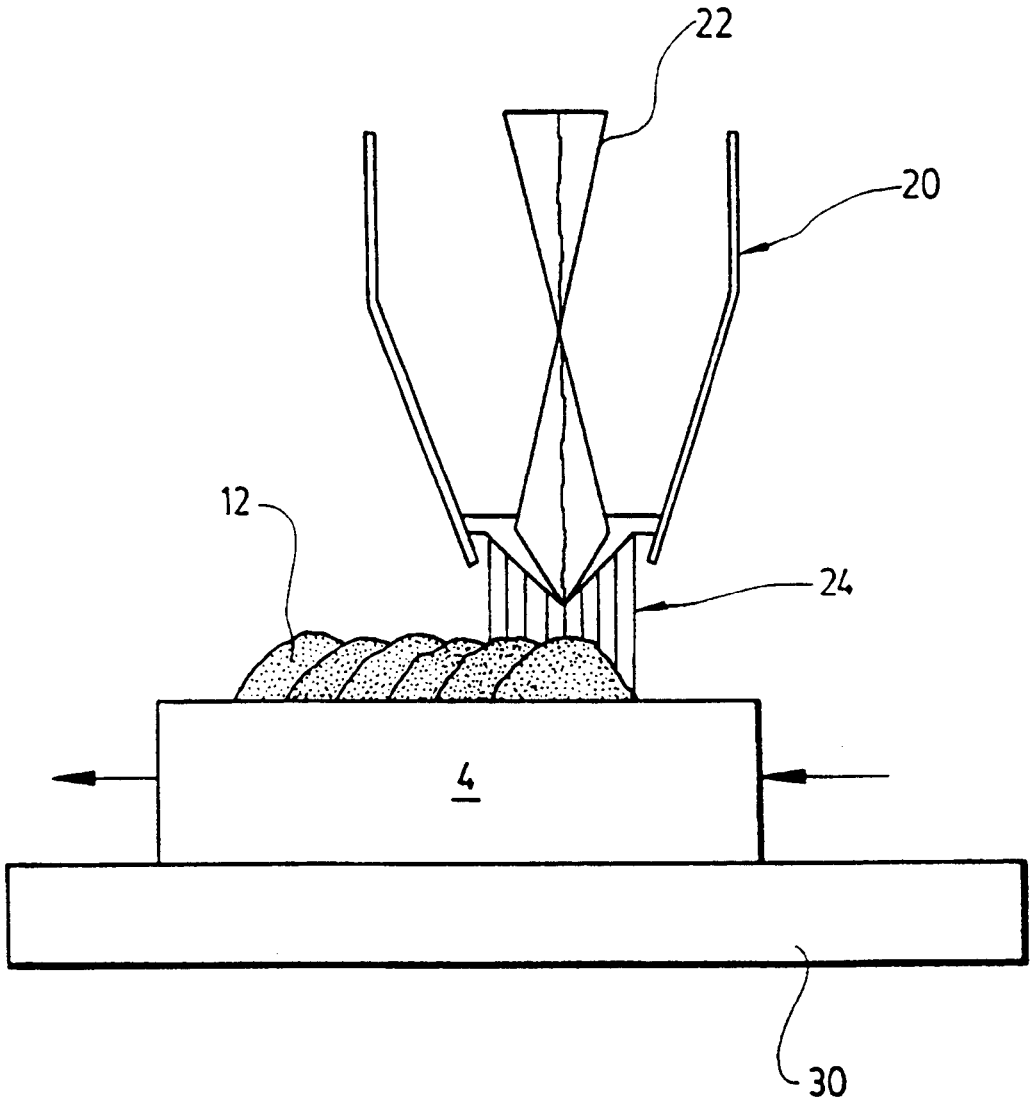
FIG. 3 represents schematically and in part a laser recharging device for the implementation of the present invention.
Figure 4:
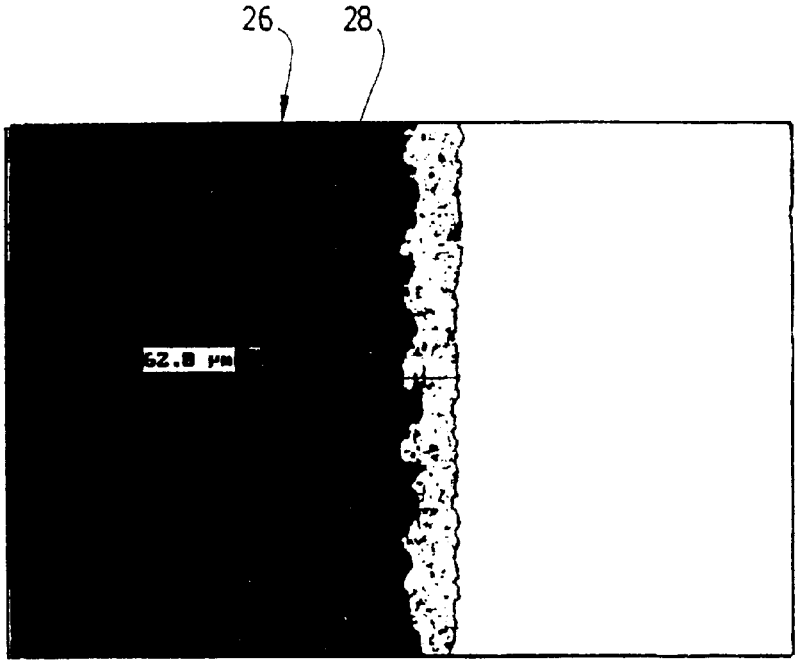
FIG. 4 is a picture taken by scanning electron microscopy (SEM) showing the microstructure of a joint formed between a coating obtained by plasma projection on a base metal.

As illustrated in FIG. 3, a coaxial nozzle (20), that is mounted at the exit of a 8 kW $CO_2$ laser beam, injects in the laser beam (22) a constant flux of powders (24) of the material to be deposited. The laser beam (22) fuses the powders (24) and welds them to the base metal (4) in the form of a cord constituting the coating (12). By sweeping the surface of the part (4), a coating is formed at the desired locations. The laser coating (12) is composed of tungsten carbide (16) particles having a very high hardness in a chromium-nickel matrix (18) and it offers an excellent resistance to wear by abrasion and erosion, as well as a very good resistance to corrosion. FIG. 4 shows the microstructure of a coating (26) comprising carbides (28) obtained by plasma projection whereas FIG. 5 shows the microstructure of a laser coating (12) on a sintered part. As can be seen, the tungsten carbide (16) particles found in the laser-deposited coating are of spheroidal shape, whereas the carbides (28) obtained by the projection plasma coating (26) have the tendency to be of angular form. We notice also that there was a fusion of the sintered part surface (4) with the metallic part (18) of the coating (12). This fusion enabled the closing of the pores present on the surface of the sintered metal (4).

The laser (22) being fixed, a four-axis numerically controlled table (30) on which lie the parts (4) to be coated enables to achieve precise and uniform deposits by relative displacement of the parts (4) with respect to the laser beam (22). Coatings of thickness with comprised between 10 $\mu$m and 1–2 mm by successive passings of the laser (22), can be accomplished.

The materials coming into the manufacturing of the coatings by laser deposit are generally mixtures of tungsten carbide, titanium carbide or boron carbide powders of great purity and of very high hardness alloyed, according to the applications, to nickel, chromium or cobalt based metallic powders. During the deposit method, the metallic powders are fused by the laser (22) while the tungsten carbide powders remain solid, preserving thus their very high hardness. These cermet-type materials confer to the coatings (12) an excellent resistance to wear by abrasion and erosion, as well as a very good resistance to corrosion.

Many characteristics of the laser deposit result in that the coatings (12) produced by this technique possess exceptional properties. First, the deposits achieved by laser are metallurgically bound to the base metal (10) and are perfectly dense (absence of porosity). The adherence obtained between the part (10) and the coating (12) is thus excellent. In contrast, the coatings produced by hot projection offer a high porosity and a special preparation of the treated surfaces to assure a good adherence.

A very precise control of the energy contribution on the base metal enables to obtain very low dilutions of base metal in the deposit inferior to 1% and to minimize, even eliminate, any deformation. Moreover, the deposit by laser allows fine metallurgic microstructures to be produced thanks to the quickness of the cooling during the treatment, allowing thus to increase the hardness of the metallic matrix (16) (2400 to 3600 HV). Finally, the use of CNC programs and controllers leads to deposits perfectly reproducible in time and whose final thickness is perfectly controlled. Many series of parts can be treated in this way.

INDUSTRIAL APPLICATIONS OF THE PRESENT INVENTION

A mechanical part manufactured by powder metallurgy but not comprising a coating according to the present invention possesses the following physical and economical characteristics:

presence of a great number of pores on the surface;

weak resistance to shocks;

generally lower mechanical capacity compared to a forged part;

lower density;

noise absorption;

possibility of use of non miscible alloys in a liquid state;

possibility of use of self-hardening alloys;

small production costs for a series of parts.

These characteristics define the power of market penetration of the technique of production of parts by powder metallurgy but it also shows its limits.

The porosity on the surface prevents the production of mechanical parts able to resist to shocks and/or to abrasive-type wear because of the brevity of the initiation period of the cracks compared to a forged or machined part. It is the reason why mechanical parts obtained by powder metallurgy are not traditionally used in very abrasive conditions or in high tension. It is here that the mechanical parts according to the present invention, more particularly the WC coating by laser deposit, rise from a revolutionary concept for this industry sector.

For illustrative purposes, the deposit by laser of a coating formed by 65% of spherical WC particles taken within a Ni-9% Cr—Co matrix, enables the following improvements of the surface of the parts made by means of metallic powder sintering:

the surface of the part is fused on a thickness ranging from 10 $\mu$m to 1 mm. This allows the closing of the pores on the surface of the part and, consequently, the increase of the resistance to shocks;

the small surface covered at a given instant by the laser beam enables the self-hardening of the exposed zone, following the displacement of the beam, by effect of heat-sink of the surrounding metallic volume;

a very low porosity of the coating, smaller than 1%, because of the complete fusion of the Ni-9% Cr powders by the laser. This is not possible with the other projection methods such as the plasma or acetylene torch, due to the large amount of heat flux projected on the part when the necessary temperature to the fusion of the projected powders is used. The hardening of the part is then destroyed; and excellent adherence of the coating on the part because of the welding zone.

Moreover, the coating obtained according to the present invention, comprising spherical carbides, offers the following advantages:

very high resistance to shocks because of the lower propensity to the initiation of cracks compared to a carbide with angular geometry;

limitation of the wear by friction because of the lower friction coefficient of spherical carbides compared to carbides with angular geometry; and limitation pure and simple of the wear of the surface of the parts because of the hardness of the carbides.

Moreover, a Ni-9% Cr matrix, as described above, offers an excellent tenacity, superior to steel.

In short, a sintered part comprising a coating according to the present invention comprises the following advantages:

excellent adherence of the coating because of the metallurgic bond between the coating and the base metal;

contrary to deposit techniques by plasma projection, absence of porosity and of cracks resulting in a good resistance to shocks;

thickness starting at 0.5 mm up to several millimetres (part recharging possible); and the carbide particles remain solid during the deposit method, thus conserving their high hardness.

The applications of the present invention can be found in a vast number of fields. More particularly, the barking tools mounted on the barker arms can advantageously be manufactured according to the present invention as well as each of the parts mentioned above.

What is claimed is:

1. A barking tool comprising a metallic body with a lower face adapted to be mounted on the extremity of a barking arm and an abrasionproof working surface, the tool being characterized in that:

the metallic body is a sintered metallic body obtained by powder metallurgy; and the abrasionproof working surface consists of a cermet coating covering the metallic body the coating having a thickness ranging from 10 $\mu$m to 1 mm metallurgically bound to the metallic body.

2. A barking tool according to claim 1, wherein the cermet coating is a laser deposit cermet coating formed on the metallic body.

3. A mechanical part with abrasionproof surface comprising:

a sintered metallic body obtained by powder metallurgy; and a cermet coating having a thickness ranging from 10 microns to 1 mm covering the metallic body and having an external surface constituting the abrasionproof surface, wherein the cermet coating is a laser deposit cermet coating, metallurgically bound to the metallic body, and comprising spheroidal-shaped carbides in a metallic matrix.

4. A mechanical part according to claim 3, wherein the cermet coating is exempt of porosity.

5. A mechanical part with abrasionproof surface according to claim 3, wherein the spheroidal-shaped carbides are selected from the group consisting of tungsten carbides, titanium carbides and boron carbides.

6. A mechanical part with abrasionproof surface according to claim 5, characterized in that the carbides are tungsten carbides.

7. A mechanical part with abrasionproof surface according to claim 5, characterized in that the metallic matrix comprises at least one metal selected from the group consisting of nickel, chromium and cobalt.

8. A mechanical part with abrasionproof surface according to claim 5, characterized in that the metallic matrix comprises nickel, chromium and cobalt.

9. A mechanical part with abrasionproof surface according to claim 5, characterized in that the metallic matrix is a Ni-9% Cr—Co matrix.

10. A mechanical part with abrasionproof surface according to claim 5, characterized in that the coating comprises 65% in weight of tungsten carbides.

11. A method for manufacturing a sintered mechanical pan with abrasionproof surface, the method being characterized in that it comprises the following steps:

a) providing a sintered metallic part obtained by powder metallurgy; and b) depositing by a laser process a cermet coating on an external surface of said part; said laser process comprising the following steps:

guiding a laser beam on the external surface of the part the laser beam releasing a certain temperature;

injecting in the laser beam a constant flux of a powder mixture of ceramic powders comprising spheroidal-shaped tungsten carbides and a metal powder comprising Ni-9% Cr—Co intended to form the cermet coating, the ceramic powders having a higher fusion temperature than the temperature of the laser beam and the metallic powder having a lower fusion temperature than the temperature of the laser beam so that the laser beam fuses the metal powder of the powder mixture that is deposited on the external surface of the part; the powder mixture being injected in the laser beam by means of a coaxial nozzle traversed in its center by the laser beam the nozzle allowing the arrival of the powder mixture and its injection in the laser beam and displacing the laser beam relative to the mechanical part to thus sweep the external surface of the metallic body and form the cermet coating.

* * * * *